US008720960B2

(12) United States Patent
Nadgouda et al.

(10) Patent No.: US 8,720,960 B2
(45) Date of Patent: May 13, 2014

(54) DOOR LOCK WITH ANTI-LIGATURE FUNCTION

(75) Inventors: Chandrashekhar Subhash Nadgouda, Karnataka (IN); Brian K. Roth, Elbert, CO (US)

(73) Assignee: Schlage Lock Company, Carmel, IN (US)

( * ) Notice: Subject to any disclaimer, the term of this patent is extended or adjusted under 35 U.S.C. 154(b) by 303 days.

(21) Appl. No.: 13/184,005

(22) Filed: Jul. 15, 2011

(65) Prior Publication Data

US 2013/0015672 A1 Jan. 17, 2013

(51) Int. Cl.
*E05B 1/00* (2006.01)
*E05C 19/00* (2006.01)

(52) U.S. Cl.
USPC ..... 292/347; 292/252; 292/348

(58) Field of Classification Search
USPC ..... 292/252, 347, 348
See application file for complete search history.

(56) References Cited

U.S. PATENT DOCUMENTS

| | | | | |
|---|---|---|---|---|
| 1,516,152 | A * | 11/1924 | Dumont | 292/347 |
| 1,534,701 | A * | 4/1925 | Gray | 464/38 |
| 1,910,125 | A | 5/1933 | Root | |
| 3,314,708 | A | 4/1967 | Welch | |
| 3,662,628 | A | 5/1972 | Schnepel | |
| 4,453,753 | A * | 6/1984 | Fayerman et al. | 292/348 |
| 4,773,240 | A * | 9/1988 | Foshee | 70/222 |
| 4,784,417 | A * | 11/1988 | Fleming et al. | 292/347 |
| 4,998,760 | A * | 3/1991 | Nixon et al. | 292/347 |
| 5,603,534 | A | 2/1997 | Fuller | |
| 5,620,216 | A | 4/1997 | Fuller | |
| 5,651,280 | A | 7/1997 | Park | |
| 5,787,743 | A * | 8/1998 | Weigard | 70/422 |
| 5,787,744 | A * | 8/1998 | Berger et al. | 70/422 |
| 5,927,777 | A | 7/1999 | Kuo et al. | |
| 6,041,630 | A | 3/2000 | Shen | |
| 6,223,567 | B1 | 5/2001 | Fadul | |
| 6,398,274 | B1 | 6/2002 | Huang et al. | |
| 6,527,314 | B2 * | 3/2003 | Brown | 292/336.3 |

(Continued)

FOREIGN PATENT DOCUMENTS

GB 2458681 9/2009

OTHER PUBLICATIONS

Anti-ligature product web pages, retrieved Apr. 21, 2011, from: http://www.krowl.co.uk/www.krowl.co.uk/info.php?p=20, 5 pages.

(Continued)

*Primary Examiner* — Carlos Lugo
(74) *Attorney, Agent, or Firm* — Michael Best & Friedrich LLP

(57) ABSTRACT

A lock device comprising a lock mechanism configured to be mounted on a door, the lock mechanism including a locking member having extended and refracted positions relative to the door for releasably securing the door relative to an adjacent structure, and the lock mechanism including a pivoting member operably connected to the locking member such that pivotal movement of the pivoting member about an axis moves the locking member between the extended and retracted positions, and an assembly including a handle manually pivotable about the axis, and a clutch mechanism connecting the handle to the pivoting member, the clutch mechanism at all times transmitting a torque below a predetermined value from the handle to the pivoting member, and the clutch mechanism at all times allowing the handle to pivot relative to the pivoting member when the torque exceeds the predetermined value.

19 Claims, 7 Drawing Sheets

(56) References Cited

U.S. PATENT DOCUMENTS

| | | | | |
|---|---|---|---|---|
| 6,546,765 | B1 * | 4/2003 | Linares | 70/210 |
| 6,705,138 | B1 | 3/2004 | Shen | |
| 6,725,693 | B2 | 4/2004 | Yu et al. | |
| 6,802,194 | B1 | 10/2004 | Shen | |
| 6,921,116 | B2 * | 7/2005 | Humes | 292/169 |
| 7,077,437 | B2 | 7/2006 | Huang | |
| 7,686,357 | B2 * | 3/2010 | Engel et al. | 292/347 |
| 7,766,751 | B2 | 8/2010 | Christensen et al. | |
| 7,793,527 | B2 | 9/2010 | Shen | |
| 7,900,978 | B2 * | 3/2011 | Zimmer | 292/100 |
| 8,210,580 | B2 * | 7/2012 | Engel et al. | 292/252 |
| 8,215,685 | B2 * | 7/2012 | Ellis | 292/336.3 |
| 2010/0126239 | A1 | 5/2010 | Berger | |
| 2010/0327611 | A1 | 12/2010 | Rees | |
| 2011/0068927 | A1 | 3/2011 | Berger | |

OTHER PUBLICATIONS

PCT/US2012/046830 International Search Report and Written Opinion dated Sep. 27, 2012 (11 pages).

* cited by examiner

DOOR LOCK WITH ANTI-LIGATURE FUNCTION

BACKGROUND

The present invention relates to door locks. More particularly, the present invention relates to a door lock for use in an institution such as a prison or mental health facility where there is a risk of a patient or prisoner using the door knob or lever to secure a rope or the like (a ligature) in an effort to hang or otherwise injure himself.

SUMMARY

The invention provides a lock device comprising a lock mechanism configured to be mounted on a door, the lock mechanism including a locking member having extended and retracted positions relative to the door for releasably securing the door relative to an adjacent structure, and the lock mechanism including a pivoting member operably connected to the locking member such that pivotal movement of the pivoting member about an axis moves the locking member between the extended and retracted positions, and an assembly including a handle manually pivotable about the axis, and a clutch mechanism connecting the handle to the pivoting member, the clutch mechanism at all times transmitting a torque below a predetermined value from the handle to the pivoting member, and the clutch mechanism at all times allowing the handle to pivot relative to the pivoting member when the torque exceeds the predetermined value.

The invention also provides lock device comprising a lock mechanism configured to be mounted on a door, the lock mechanism including a locking member having extended and retracted positions relative to the door for releasably securing the door relative to an adjacent structure, and a pivoting member operably connected to the locking member such that pivotal movement of the pivoting member about an axis moves the locking member between the extended and retracted positions, the lock mechanism having a locked state wherein the pivoting member is prevented from pivoting and an unlocked state wherein the pivoting member is pivotable, and an assembly including a handle manually pivotable about the axis, a cam member fixed to the pivoting member for pivotal movement therewith, the cam member having a surface having therein a recess, a rotor fixed to the handle for pivotal movement therewith, the rotor having a surface facing the surface of the cam member and having therein a recess, a drive member seated in the recess of the cam member and in the recess of the rotor when the rotor is in a normal position relative to the cam member, and a spring biasing the surface of the cam member and the surface of the rotor together, such that, when the drive member is seated in the recesses and the lock mechanism is in the unlocked state, pivotal movement of the rotor about the axis is transmitted to the cam member via the drive member, whereby pivotable movement of the handle is transmitted to the pivoting member of the lock mechanism, and such that, when the lock mechanism is in the locked state and the handle is pivoted with a torque greater than an amount determined by a force of the spring, the drive member moves against the force of the spring and out of the recess, so that the rotor is able to pivot relative to the cam member, whereby the handle is able to pivot relative to the pivoting member of the lock mechanism.

The invention also provides lock device comprising a lock mechanism configured to be mounted on a door, the lock mechanism including a locking member having extended and retracted positions relative to the door for releasably securing the door relative to an adjacent structure, and a pivoting member operably connected to the locking member such that pivotal movement of the pivoting member about an axis moves the locking member between the extended and retracted positions, the lock mechanism having a locked state wherein the pivoting member is prevented from pivoting and an unlocked state wherein the pivoting member is pivotable, an exterior assembly including a manually movable exterior member operably connected to the locking member for moving the locking member between the extended and retracted positions, and an interior assembly including a handle manually pivotable about the axis, the handle having a lever portion and a shank portion, a cam member having a cylindrical portion fixed to the pivoting member for pivotal movement therewith, and the cam member having a circular plate portion extending in a flange-like manner from an outer end of the cylindrical portion, the plate portion of the cam member having a generally planar cam surface generally perpendicular to the axis, the cam surface having therein first and second diametrically spaced, generally circular recesses, each of the recesses having a depth, the cam surface having therein an annular recess centered on the axis, the annular recess intersecting the recesses and having a depth less than the depth of the recesses, and the cam surface also having therein a cylindrical recess centered on the axis and located inside the annular recess, a rotor having a cylindrical portion fixed to the handle for pivotal movement therewith, and the rotor having a circular plate portion extending in a flange-like manner from an inner end of the cylindrical portion of the rotor, the plate portion of the rotor having a generally planar inner surface generally perpendicular to the axis, the inner surface facing the cam surface and having thereon a cylindrical portion extending into the cylindrical recess in the cam surface, and the plate portion also having a generally planar outer surface generally perpendicular to the axis, the outer surface facing away from the cam surface, and the plate portion having therethrough first and second diametrically spaced openings extending between the inner and outer surfaces and respectively aligned with the first and second recesses in the cam surface when the rotor is in a normal position relative to the cam member, a first ball seated in the first recess of the cam member and in the first opening of the plate portion when the rotor is in the normal position, a second ball seated in the second recess of the cam member and in the second opening of the plate portion when the rotor is in the normal position, a spring seat having a cylindrical sleeve surrounding the cylindrical portion of the rotor, and the spring seat having a circular plate portion extending in a flange-like manner from an inner end of the cylindrical sleeve, the plate portion having a generally planar inner surface generally perpendicular to the axis, the inner surface of the plate portion of the spring seat facing the outer surface of the plate portion of the rotor, and the inner surface of the plate portion of the spring seat bearing against the first and second balls and having therein an annular recess which is centered on the axis and in which the balls are seated, and the plate portion of the spring seat also having a generally planar outer surface generally perpendicular to the axis, the outer surface of the plate portion of the spring seat facing away from the outer surface of the plate portion of the rotor, a coil spring surrounding the sleeve portion, the spring having an inner end engaging the outer surface of the plate portion of the spring seat, and the spring having an outer end engaging the handle, such that the spring exerts a force on and biases the plate portion of the spring seat against the first and second balls and thereby biases the first and second balls into the first and second recesses, and a cover member fixed to the handle, the cover member having therein a circular opening which is centered on the axis and through which the cylindrical portion of the cam member extends, and the cover member engaging the plate portion of the cam member so that the plate portion of the cam member, the rotor, the balls, the spring seat and the spring are held between the cover member and an inner surface of the handle and are completely contained within the shank portion of the handle, such that, when the first and second balls are seated in the first and second recesses and the lock mechanism is in the unlocked state, pivotal movement of the rotor about the axis is transmitted to the cam member via the first and second balls, whereby pivotable movement of the handle is transmitted to the pivoting member of the lock mechanism, and such that, when the lock mechanism is in the locked state and the handle is pivoted with a torque greater than an amount determined by the force of the spring, the first and second balls move against the force of the spring and out of the first and second recesses and into the annular groove in the cam surface, so as to move the spring seat axially relative to the rotor and away from the outer surface of the plate portion of the rotor, and so that the rotor is able to pivot relative to the cam member, whereby the handle is able to pivot relative to the pivoting member of the lock mechanism, providing an anti-ligature function.

Other aspects of the invention will become apparent by consideration of the detailed description and accompanying drawings.

BRIEF DESCRIPTION OF THE DRAWINGS

FIG. 3 is another exploded perspective view of the interior handle.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
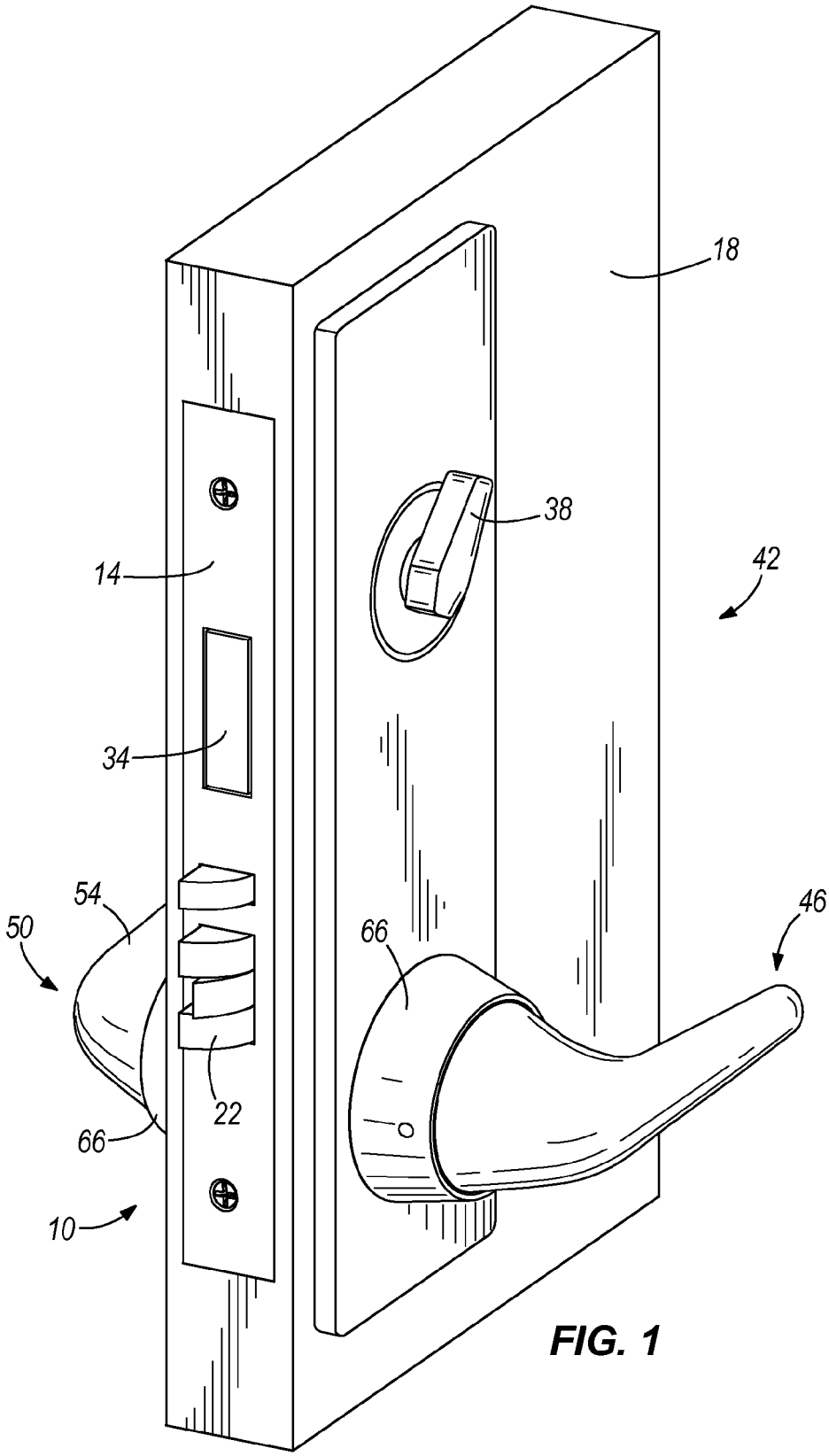
FIG. 1 is a perspective view of a lock device embodying the invention.
Figure 2:
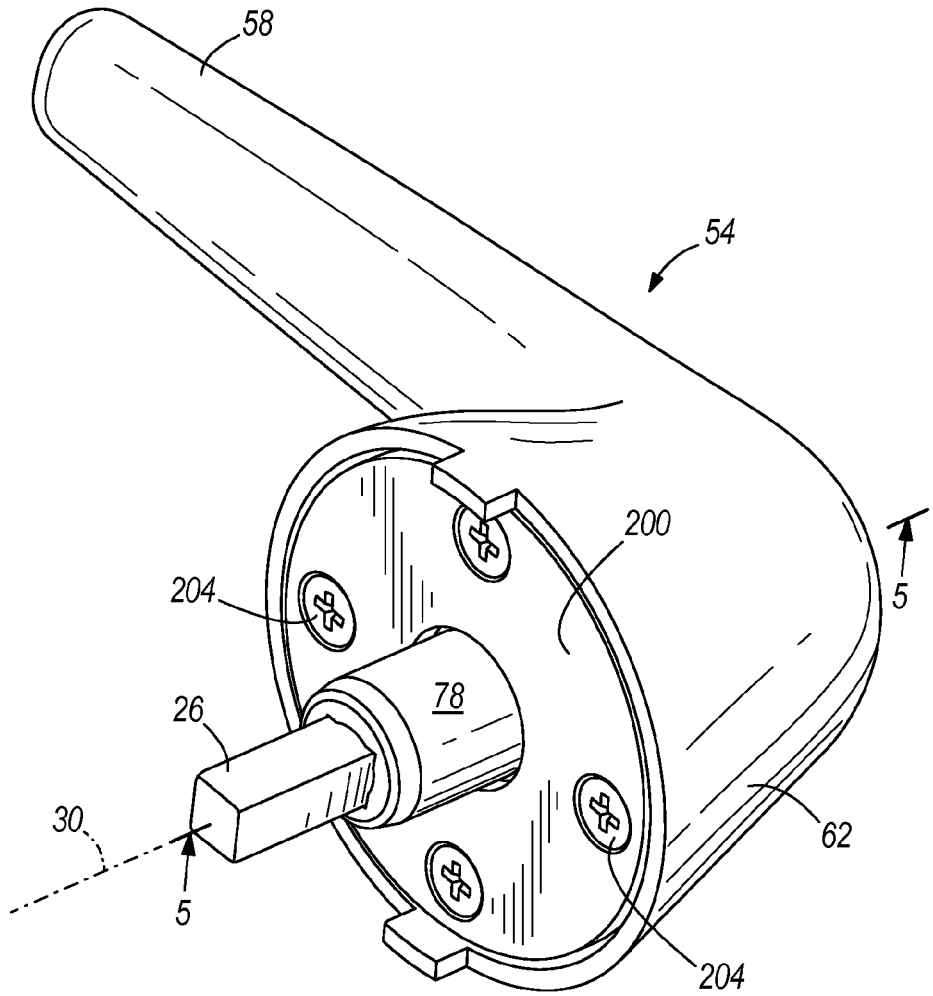
FIG. 2 is a perspective view of the interior handle.

FIG. 1 shows a lock device 10 embodying the invention. The lock device is intended for use in an institution such as a prison or mental health facility, so the device is locked on the outside, as described below, rather than on the inside. The lock device 10 comprises a lock mechanism 14 mounted on a door 18 (partially shown). While the illustrated lock device is a mortise lock, it should be understood that the invention applies to other types of locks. The lock mechanism 14 includes a locking member or latch 22 having extended (shown) and retracted (not shown) positions relative to the door for releasably securing the door relative to an adjacent structure, such as a door jamb. The lock mechanism 14 also includes (see FIGS. 2-7) a pivoting member or spindle 26 operably connected to the latch 22 such that pivotal movement of the spindle 26 about an axis 30 moves the latch between the extended and refracted positions. The manner in which the spindle 26 moves the latch 22 is well known. The spindle 26 is generally square in cross-section. The lock mechanism 14 also includes (see FIG. 1) a locking member or deadbolt 34 having extended (not shown) and retracted (shown) positions relative to the door 18. The lock mechanism 14 has a locked state wherein the spindle 26 is prevented from pivoting and an unlocked state wherein the spindle is pivotable. These states can be controlled by a key (not shown) or by a thumbturn 38. In the illustrated construction, the lock mechanism 14 is in the unlocked state when the deadbolt 34 is retracted. The lock mechanism 14 is in the locked state when the deadbolt 34 is extended. Such an arrangement is known.

The lock device 10 also comprises an exterior assembly 42 including the thumbturn 38 for operating the deadbolt as is known in the art. As mentioned above, the device locks on the outside or exterior. The exterior assembly 42 also includes a manually movable exterior member or lever 46 pivotable about the axis 30 and operably connected to the latch 22 for moving the latch between the extended and retracted positions. The exterior lever 46 can also retract the deadbolt 34 as is known in the art.

The lock device 10 also comprises an interior assembly 50 including an interior handle or lever 54 manually pivotable about the axis. The handle 54 has (see FIG. 2) a lever portion 58 and a shank portion 62. The handle 54 is shown in FIG. 1 with a trim ring 66 around the shank portion 62, and is shown in the other figures without the trim ring.

The lock device 10 also comprises (see FIG. 3) a clutch mechanism 70 connecting the handle 54 to the spindle 26, the clutch mechanism 70 at all times transmitting a torque below a predetermined value from the handle 54 to the spindle 26, and the clutch mechanism 70 at all times allowing the handle 54 to pivot relative to the spindle 26 when the torque exceeds the predetermined value. In other words, the clutch mechanism 70 cannot be selectively engaged or disengaged. It always functions as described. The predetermined value is determined by the force of a spring, which is described below.

Figure 3:
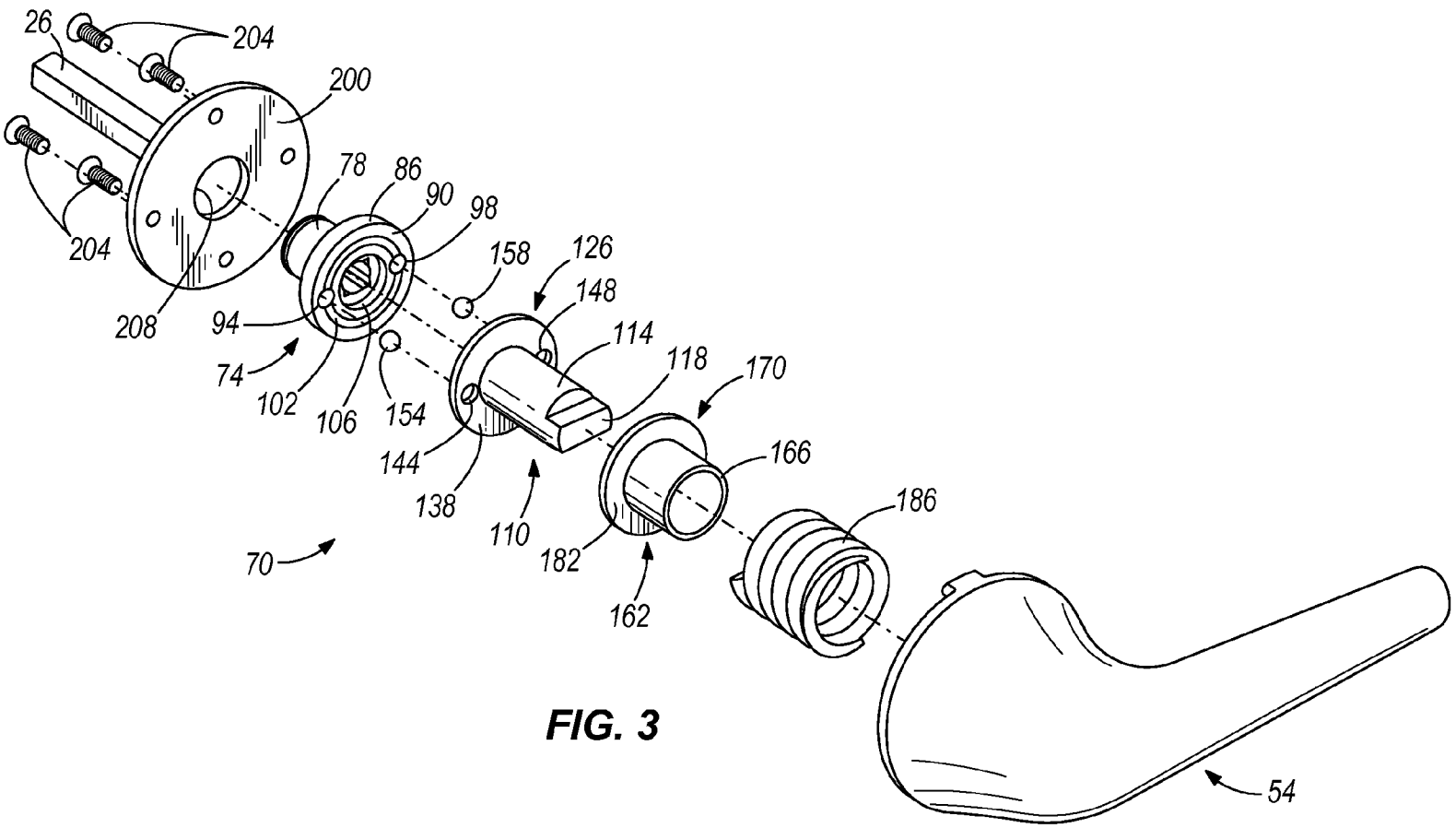
FIG. 3 is an exploded perspective view of the interior handle.
Figure 4:
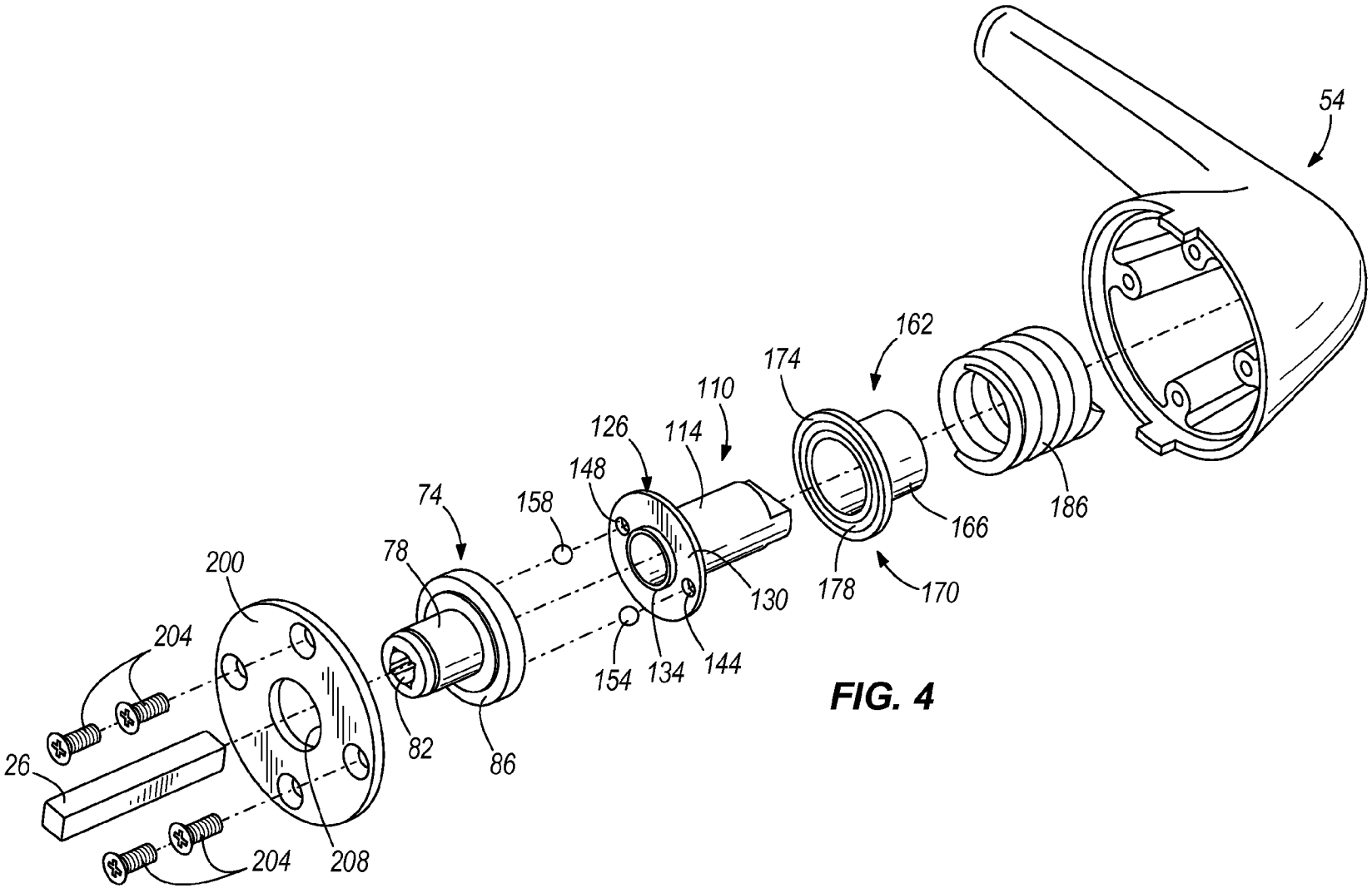
Figure 5:
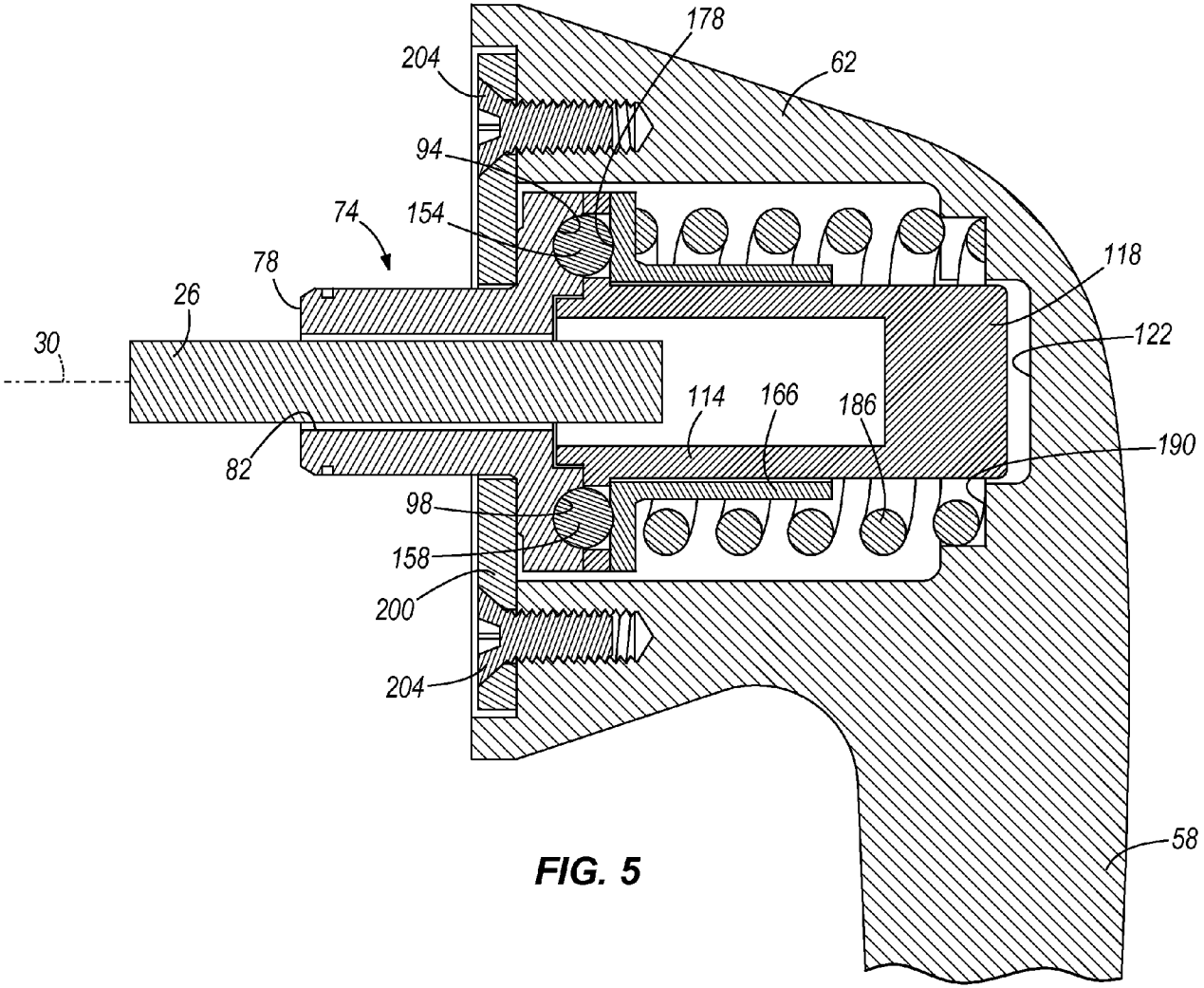
FIG. 5 is a sectional view along line 5-5 in FIG. 2.

The clutch mechanism 70 includes a cam member 74 having a cylindrical portion 78 fixed to the spindle 26 for pivotal movement therewith. As shown in FIGS. 4 and 5, the cylindrical portion 78 has therein a recess 82 that extends along the axis 30 and that is generally square in cross-section. The spindle 26 extends into the recess 82 such that the spindle 26 cannot pivot to any significant extent relative to the cam member 74. The cam member 74 has a circular plate portion 86 extending in a flange-like manner from an outer end of the cylindrical portion 78 (the right end in FIG. 4). The plate portion 86 has (see FIG. 3) a generally planar cam surface 90 generally perpendicular to the axis 30, the cam surface 90 having therein first and second generally circular recesses 94 and 98. More particularly, each of the recesses 94 and 98 forms a portion of a sphere. The recesses 94 and 98 are diametrically spaced, i.e., they are spaced along a line perpendicular to the axis 30. The cam surface 90 also has therein an annular recess 102 centered on the axis 30, the annular recess 102 intersecting the recesses 94 and 98 and having a depth less than the depth of the recesses. The cam surface 90 also has therein a cylindrical recess 106 centered on the axis 30 and located inside the annular recess 102. In the illustrated construction, as shown in FIG. 3, the cylindrical recess 106 communicates with the square recess 82, but this need not be the case.

The clutch mechanism 70 also includes a rotor 110 having a hollow cylindrical portion 114 fixed to the handle 54 for pivotal movement therewith. As shown in FIGS. 3 and 5, the cylindrical portion 114 has thereon a rectangular extension 118 that extends into a rectangular recess 122 inside the handle 54, such that the rotor 110 cannot pivot to any significant extent relative to the handle 54. The rotor 110 also has a circular plate portion 126 extending in a flange-like manner from an inner end (the left end in FIG. 4) of the cylindrical portion 114, the plate portion 126 having a generally planar inner surface 130 generally perpendicular to the axis 30. The inner surface 130 faces the cam surface 90 and has thereon a cylindrical portion 134 extending into the cylindrical recess 106 in the cam surface 90 to help maintain the positions of the cam member 74 and the rotor 110. The plate portion 126 also has a generally planar outer surface 138 generally perpendicular to the axis 30, the outer surface 138 facing away from the cam surface 90. The plate portion 126 also has therethrough first and second diametrically spaced openings or through-holes 144 and 148 extending between the inner and outer surfaces 130 and 138 and respectively aligned with the recesses 94 and 98 in the cam surface 90 when the rotor 110 is in a normal position relative to the cam member 74, as shown in FIG. 5.

The clutch mechanism 70 also includes first and second balls or drive members 154 and 158 respectively seated in the openings 144 and 148 of the plate portion 126. The balls remain seated in the openings 144 and 148 during operation of the clutch mechanism. The balls 154 and 158 are also respectively seated in the recesses 94 and 98 of the cam member 74 when the rotor 110 is in the normal position. This is shown in FIG. 5. The clutch mechanism 70 also includes a spring seat 162 having a cylindrical sleeve 166 surrounding the cylindrical portion 114 of the rotor 110. The spring seat 162 also has a circular plate portion 170 extending in a flange-like manner from an inner end (the left end in FIG. 4) of the cylindrical sleeve 166, the plate portion 170 having a generally planar inner surface 174 generally perpendicular to the axis 30. The inner surface 174 faces the outer surface 138 of the plate portion 126 of the rotor 110, and the inner surface 174 bears against the balls 154 and 158 and has therein an annular recess 178 in which the balls are seated. The recess 178 is centered on the axis 30. The plate portion 170 of the spring seat 162 also has a generally planar outer surface 182 generally perpendicular to the axis 30, the outer surface 182 facing away from the outer surface 138 of the rotor 110.

The clutch mechanism 70 also includes a coil spring 186 surrounding the sleeve portion 166, the spring 186 having an inner end engaging the outer surface 182 of the spring seat 162, and the spring 186 having an outer end engaging an inner surface 190 of the handle 54, as shown in FIG. 5. The spring 186 exerts a force on and biases the plate portion 170 of the spring seat 162 against the balls 154 and 158 and thereby biases the balls into the recesses 94 and 98 in the cam surface 90. Specifically, each end of the spring 186 has a flat engaging the respective surface.

The lock device 10 also comprises a cover member 200 fixed to the handle 54. In the illustrated construction, the cover member 200 is fixed to the shank 62 of the handle with four screws 204. The cover member 200 has therein a circular opening 208 which is centered on the axis 30 and through which the cylindrical portion 78 of the cam member 74 extends. The cover member 200 engages the plate portion 86 of the cam member 74 so that the plate portion 86, the rotor 110, the balls 154 and 158, the spring seat 162 and the spring 186 are held between the cover member 200 and the inner surface 190 of the handle 54, and the clutch mechanism 70 is completely contained within the shank portion 62 of the handle, as shown in FIG. 5. This allows the handle 54 and the clutch mechanism 70 to be sold and installed as a unit.

Figure 6:
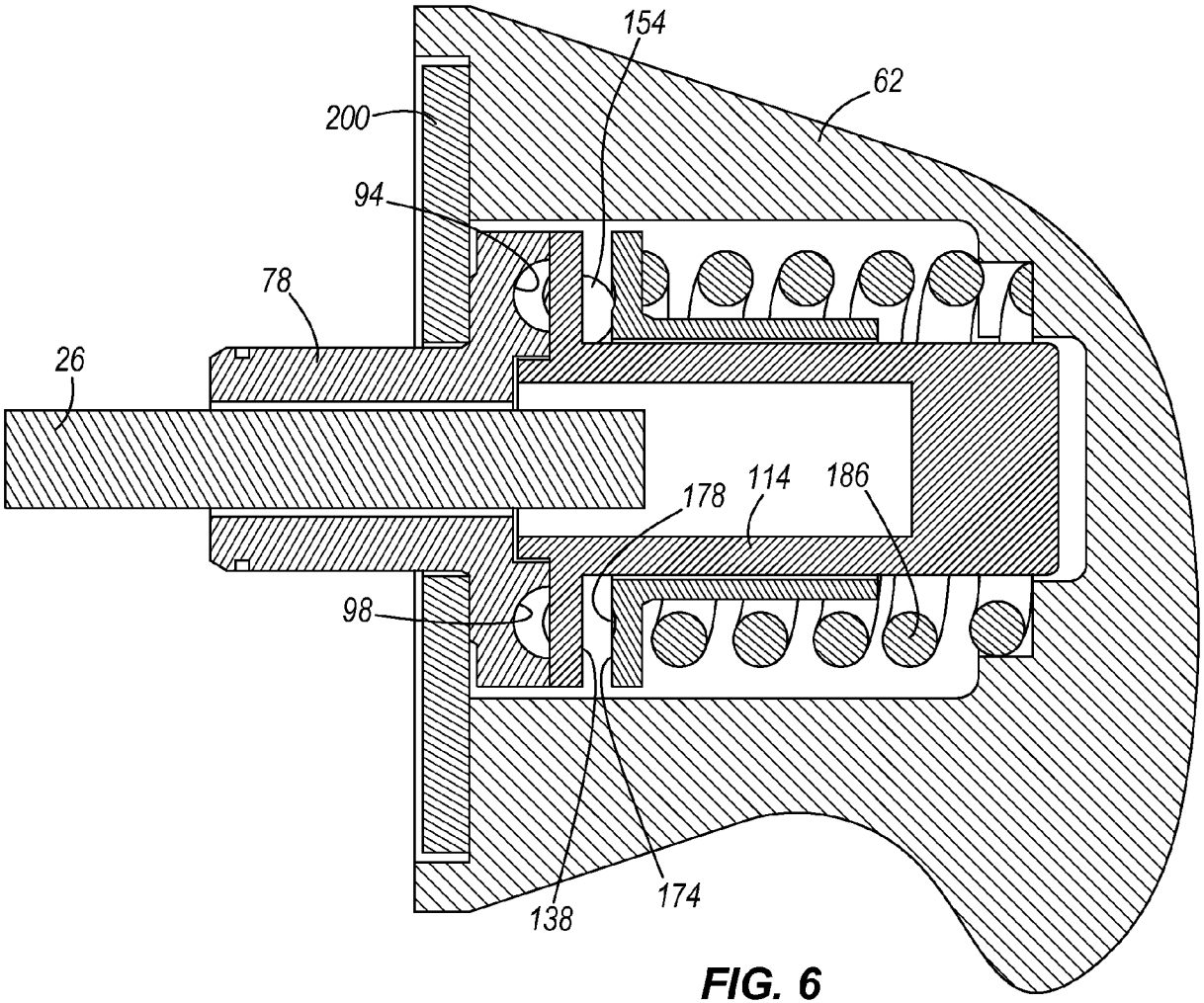
FIG. 6 is view similar to FIG. 5 in which the lever is pivoted relative to the spindle and the cam member.
Figure 7:
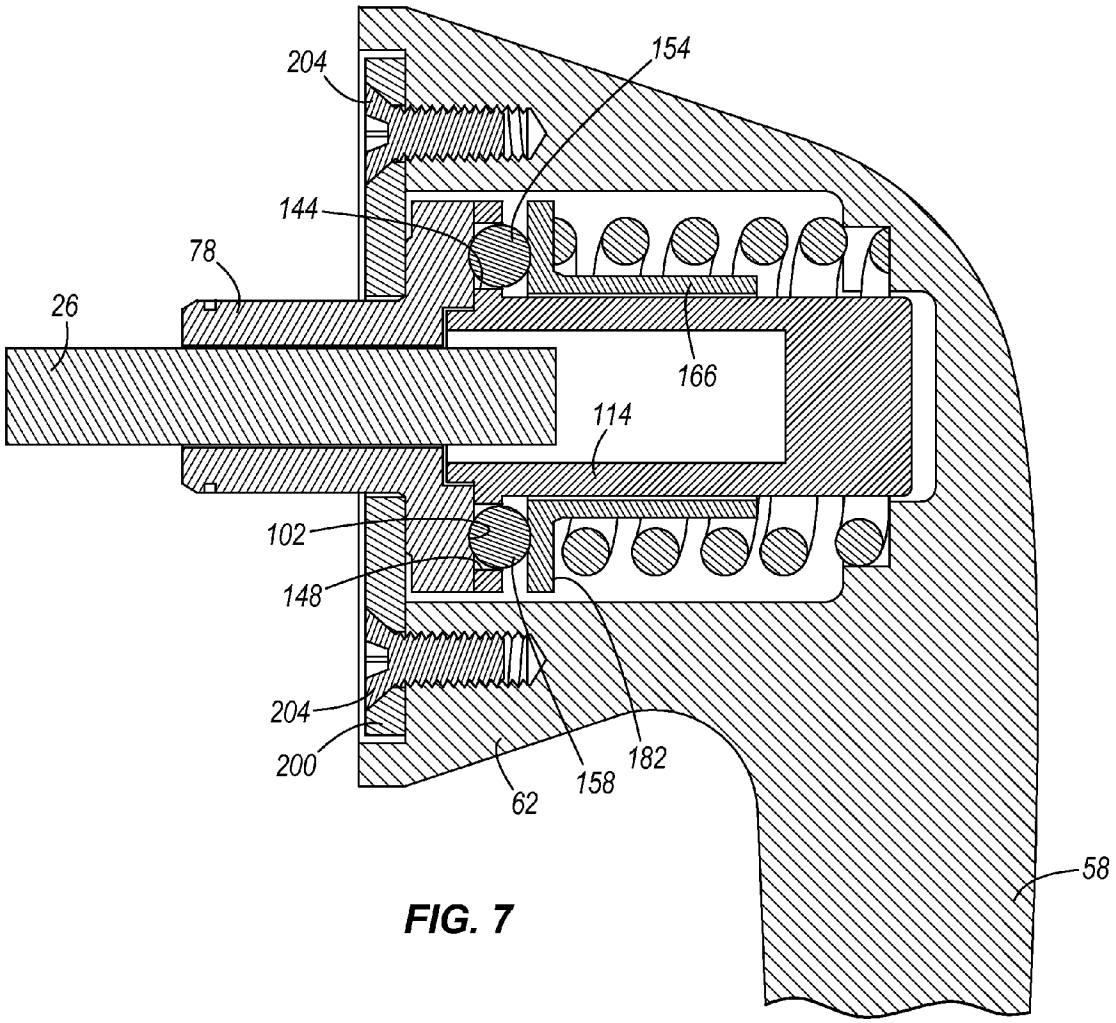
FIG. 7 is view similar to FIG. 6 with the section taken through the balls.

When the balls 154 and 158 are seated in the recesses 94 and 98 and the lock mechanism 14 is in the unlocked state, pivotal movement of the rotor 110 about the axis 30 is transmitted to the cam member 74 via the balls, whereby pivotable movement of the handle 54 is transmitted to the spindle 26. Specifically, when the rotor pivots, the walls of the rotor openings 144 and 148 push on the balls 154 and 158, and the balls push on the walls of the cam member recesses 94 and 98. When the lock mechanism 14 is in the locked state and the handle 54 is pivoted with a torque greater than a predetermined amount determined by the force of the spring 186, pivotal movement of the rotor 110 causes the balls 154 and 158 to move, against the force of the spring 186 (to the right in FIG. 5), out of the recesses 94 and 98 and into the annular groove 102 in the cam surface 90, as shown in FIGS. 6 and 7. The balls remain in the openings 144 and 148 as the rotor 110 pivots relative to the cam member 74. In FIG. 6, the cam member 74 and the spindle 26 are in the same position as in FIG. 5, but the handle 54 and the rotor 110 have pivoted and the balls have moved out of the recesses 94 and 98 and into the groove 102. FIG. 7 is a section view through the balls 154 and 158 in the position of FIG. 6 and shows how the balls are seated in the annular grooves 102 and 178 of the cam member and of the spring seat 162. Movement of the balls out of the recesses 94 and 98 and into the groove 102 moves the spring seat 162 axially relative to the rotor 110 and away from the outer surface 138 of the plate portion 126 of the rotor 110 (to the right from the position in FIG. 5 to the position in FIGS. 6 and 7). Thus, the rotor 110 is able to pivot relative to the cam member 74, whereby the handle 54 is able to pivot relative to the spindle 26, providing an anti-ligature function.

To summarize, the handle 54 has a normal position (extending horizontally in the illustrated construction), and the clutch mechanism 70 has a normal state wherein the handle 54 is drivingly connected to the spindle 26 (the balls 154 and 158 are in the recesses 94 and 98), and a slipping state in which the handle is not drivingly connected to the spindle 26 (the balls are not in the recesses 94 and 98). The clutch mechanism 70 automatically returns to the normal state (the balls return to the recesses 94 and 98) when the handle 54 returns to the normal position.

If a person places a rope around the handle 54 when the lock mechanism 14 is unlocked, a weight on the rope will simply turn the handle 54 to open the door, and the rope will slide off the handle. The torque required to pivot the spindle 26 will not exceed the predetermined value when the lock mechanism is unlocked. If a person places a rope around the handle 54 when the lock mechanism 14 is locked, a weight on the rope exerting on the handle a torque greater than the predetermined value will cause the clutch mechanism 70 to slip, the handle 54 will pivot downward without opening the door, and the rope will slip off the handle.

It should be understood that various alternative constructions are within the scope of the invention. For example, the recesses 144 and 148 in the rotor need not be through-holes. They could be blind recesses, like those in the cam surface 90. All recesses could have other shapes. The deeper recesses could be in the cam surface 90 and the balls 154 and 158 could move out of the recesses in rotor 110, or the recesses 94, 98, 144 and 148 could be the same depth and the balls could move out of both. The drive members need not be balls. Other rolling or bearing-type members could be used. Another possible alternative is to eliminate the spring seat 162 and have the spring 186 push directly on the rotor 110. This alternative would require the recesses 144 and 148 in the rotor 110 to be blind, rather than being through-holes. It would also require more clearance for the rotor 110 to move axially relative to the handle 54. Use of the spring seat 162 is preferred for ease of construction of the rotor.

While various suitable materials can be employed, the cam member 74, rotor 110, spring seat 162 and balls 154 and 158 are preferably made of hardened steel. The spring seat 162 may pivot with the rotor 110, or the balls may move with the rotor 110 relative to the spring seat 162.

Various features and advantages of the invention are set forth in the following claims.

The invention claimed is:

1. A lock device comprising:

a lock mechanism configured to be mounted on a door, the lock mechanism including a locking member having extended and retracted positions relative to the door for releasably securing the door relative to an adjacent structure, and the lock mechanism including a pivoting member operably connected to the locking member such that pivotal movement of the pivoting member about an axis moves the locking member between the extended and retracted positions, and an assembly including a handle manually pivotable about the axis, and a clutch mechanism connecting the handle to the pivoting member, the clutch mechanism transmitting a torque from the handle to the pivoting member when the torque is below a predetermined value, and the clutch mechanism allowing the handle to pivot relative to the pivoting member when the torque exceeds the predetermined value, wherein the clutch mechanism includes a cam member fixed to the pivoting member for pivotal movement therewith, the cam member having a cam surface having therein a cam recess, a rotor fixed to the handle for pivotal movement therewith, the rotor having a rotor surface facing the cam surface and having therein a rotor recess, a drive member seated in the cam recess and in the rotor recess when the rotor is in a normal position relative to the cam member, and a spring biasing the cam surface and the rotor surface together, such that, when the drive member is seated in the recesses and the handle is pivoted with a torque less than the predetermined value, pivotal movement of the rotor about the axis is transmitted to the cam member via the drive member, whereby pivotable movement of the handle is transmitted to the pivoting member of the lock mechanism, and such that, when the handle is pivoted with a torque greater than the predetermined value, the drive member moves against the force of the spring and out of at least one of the recesses, so that the rotor is able to pivot relative to the cam member, whereby the handle is able to pivot relative to the pivoting member of the lock mechanism.

2. A lock device as set forth in claim 1 wherein the lock mechanism has a locked state wherein the pivoting member is prevented from pivoting and an unlocked state wherein the pivoting member is pivotable.

3. A lock device as set forth in claim 2 wherein pivotal movement of the rotor is transmitted to the cam member when the drive member is seated in the recesses and the lock mechanism is in the unlocked state and wherein the drive member moves against the force of the spring and out of at least one of the recesses, so that the rotor is able to pivot relative to the cam member, when the lock mechanism is in the locked state and the handle is pivoted with a torque greater that the predetermined value.

4. A lock device as set forth in claim 2 wherein the assembly is an interior assembly, wherein the device further comprises an exterior assembly including an exterior deadbolt, and wherein the locked and unlocked states are determined by the position of the exterior deadbolt.

5. A lock device as set forth in claim 1 wherein the handle has a normal position, and wherein the clutch mechanism has a normal state wherein the handle is drivingly connected to the pivoting member, and a slipping state in which the handle is not drivingly connected to the pivoting member, and wherein the clutch mechanism automatically returns to the normal state when the handle returns to the normal position.

6. A lock device as set forth in claim 1 wherein the handle has a lever portion and a shank portion, and wherein the clutch mechanism is completely contained within the shank portion of the handle.

7. A lock device as set forth in claim 6 and further comprising a cover member fixed to the handle, wherein the clutch mechanism is held between the cover member and an inner surface of the handle.

8. A lock device as set forth in claim 1 and further comprising a cover member fixed to the handle, wherein a portion of the cam member, the rotor, the drive member and the spring are held between the cover member and an inner surface of the handle.

9. A lock device as set forth in claim 8 wherein the cover member has therein a circular opening which is centered on the axis and through which a portion of the cam member extends.

10. A lock device as set forth in claim 1 wherein the cam surface is generally planar and generally perpendicular to the axis, and wherein the rotor surface is generally planar and generally perpendicular to the axis.

11. A lock device as set forth in claim 10 wherein the cam surface has therein first and second diametrically spaced, generally circular cam recesses, and wherein the rotor surface has therein first and second diametrically spaced, generally circular rotor recesses, and wherein the clutch mechanism includes first and second drive members, the first drive member seated in the first cam recess and in the first rotor recess when the rotor is in the normal position, and the second drive member seated in the second cam recess and in the second rotor recess when the rotor is in the normal position.

12. A lock device as set forth in claim 11 wherein the cam and rotor recesses are circular, and wherein the drive members are first and second balls.

13. A lock device as set forth in claim 12 wherein each of the cam recesses has a depth, and the cam surface has therein an annular recess centered on the axis, the annular recess intersecting the cam recesses and having a depth less than the depth of the cam recesses.

14. A lock device as set forth in claim 12 wherein the rotor recesses are through-holes, and wherein, when the handle is pivoted with a torque greater than the predetermined value, the balls move against the force of the spring and out of the cam recesses.

15. A lock device as set forth in claim 14 wherein the rotor has a cylindrical portion fixed to the handle for pivotal movement therewith, and the rotor has a circular plate portion extending from an inner end of the cylindrical portion of the rotor, the plate portion having thereon the rotor surface, the plate portion also having a generally planar outer surface which faces away from the cam surface and which is generally perpendicular to the axis, and the through-holes passing through the plate portion from the rotor surface to the outer surface.

16. A lock device as set forth in claim 15 wherein the clutch mechanism further includes a spring seat having a cylindrical sleeve surrounding the cylindrical portion of the rotor, the spring seat having a circular plate portion extending from an inner end of the cylindrical sleeve, the plate portion having a generally planar inner surface generally perpendicular to the axis, the inner surface of the plate portion of the spring seat facing the outer surface of the plate portion of the rotor, and the inner surface of the plate portion of the spring seat bearing against the first and second balls, and the plate portion of the spring seat also having a generally planar outer surface generally perpendicular to the axis, the outer surface of the plate portion of the spring seat facing away from the outer surface of the plate portion of the rotor, and wherein the spring is a coil spring surrounding the sleeve portion, the spring having an inner end engaging the outer surface of the plate portion of the spring seat, and the spring having an outer end engaging the handle, such that the spring exerts a force on and biases the plate portion of the spring seat against the first and second balls and thereby biases the first and second balls into the first and second cam recesses.

17. A lock device as set forth in claim 16 wherein the inner surface of the spring seat has therein an annular recess which is centered on the axis and in which the balls are seated.

18. A lock device comprising:

a lock mechanism configured to be mounted on a door, the lock mechanism including a locking member having extended and retracted positions relative to the door for releasably securing the door relative to an adjacent structure, and a pivoting member operably connected to the locking member such that pivotal movement of the pivoting member about an axis moves the locking member between the extended and retracted positions, the lock mechanism having a locked state wherein the pivoting member is preventing from pivoting and an unlocked state wherein the pivoting member is pivotable, and an assembly including a handle manually pivotable about the axis, a cam member fixed to the pivoting member for pivotal movement therewith, the cam member having a surface having therein a recess, a rotor fixed to the handle for pivotal movement therewith, the rotor having a surface facing the surface of the cam member and having therein a recess, a drive member seated in the recess of the cam member and in the recess of the rotor when the rotor is in a normal position relative to the cam member, and a spring biasing the surface of the cam member and the surface of the rotor together, such that, when the drive member is seated in the recesses and the lock mechanism is in the unlocked state, pivotal movement of the rotor about the axis is transmitted to the cam member via the drive member, whereby pivotable movement of the handle is transmitted to the pivoting member of the lock mechanism, and such that, when the lock mechanism is in the locked state and the handle is pivoted with a torque greater than an amount determined by a force of the spring, the drive member moves against the force of the spring and out of the recess, so that the rotor is able to pivot relative to the cam member, whereby the handle is able to pivot relative to the pivoting member of the lock mechanism.

19. A lock device comprising:

a lock mechanism configured to be mounted on a door, the lock mechanism including a locking member having extended and retracted positions relative to the door for releasably securing the door relative to an adjacent structure, and a pivoting member operably connected to the locking member such that pivotal movement of the pivoting member about an axis moves the locking member between the extended and retracted positions, the lock mechanism having a locked state wherein the pivoting member is prevented from pivoting and an unlocked state wherein the pivoting member is pivotable, an exterior assembly including a manually movable exterior member operably connected to the locking member for moving the locking member between the extended and retracted positions, and an interior assembly including a handle manually pivotable about the axis, the handle having a lever portion and a shank portion, a cam member having a cylindrical portion fixed to the pivoting member for pivotal movement therewith, and the cam member having a circular plate portion extending from an outer end of the cylindrical portion, the plate portion of the cam member having a generally planar cam surface generally perpendicular to the axis, the cam surface having therein first and second diametrically spaced, generally circular recesses, each of the recesses having a depth, the cam surface having therein an annular recess centered on the axis, the annular recess intersecting the recesses and having a depth less than the depth of the recesses, and the cam surface also having therein a cylindrical recess centered on the axis and located inside the annular recess, a rotor having a cylindrical portion fixed to the handle for pivotal movement therewith, and the rotor having a circular plate portion extending from an inner end of the cylindrical portion of the rotor, the plate portion of the rotor having a generally planar inner surface generally perpendicular to the axis, the inner surface facing the cam surface and having thereon a cylindrical portion extending into the cylindrical recess in the cam surface, and the plate portion also having a generally planar outer surface generally perpendicular to the axis, the outer surface facing away from the cam surface, and the plate portion having therethrough first and second diametrically spaced openings extending between the inner and outer surfaces and respectively aligned with the first and second recesses in the cam surface when the rotor is in a normal position relative to the cam member, a first ball seated in the first recess of the cam member and in the first opening of the plate portion when the rotor is in the normal position, a second ball seated in the second recess of the cam member and in the second opening of the plate portion when the rotor is in the normal position, a spring seat having a cylindrical sleeve surrounding the cylindrical portion of the rotor, and the spring seat having a circular plate portion extending from an inner end of the cylindrical sleeve, the plate portion having a generally planar inner surface generally perpendicular to the axis, the inner surface of the plate portion of the spring seat facing the outer surface of the plate portion of the rotor, and the inner surface of the plate portion of the spring seat bearing against the first and second balls and having therein an annular recess which is centered on the axis and in which the balls are seated, and the plate portion of the spring seat also having a generally planar outer surface generally perpendicular to the axis, the outer surface of the plate portion of the spring seat facing away from the outer surface of the plate portion of the rotor, a coil spring surrounding the sleeve portion, the spring having an inner end engaging the outer surface of the plate portion of the spring seat, and the spring having an outer end engaging the handle, such that the spring exerts a force on and biases the plate portion of the spring seat against the first and second balls and thereby biases the first and second balls into the first and second recesses, and a cover member fixed to the handle, the cover member having therein a circular opening which is centered on the axis and through which the cylindrical portion of the cam member extends, and the cover member engaging the plate portion of the cam member so that the plate portion of the cam member, the rotor, the balls, the spring seat and the spring are held between the cover member and an inner surface of the handle and are completely contained within the shank portion of the handle, such that, when the first and second balls are seated in the first and second recesses and the lock mechanism is in the unlocked state, pivotal movement of the rotor about the axis is transmitted to the cam member via the first and second balls, whereby pivotable movement of the handle is transmitted to the pivoting member of the lock mechanism, and such that, when the lock mechanism is in the locked state and the handle is pivoted with a torque greater than an amount determined by the force of the spring, the first and second balls move against the force of the spring and out of the first and second recesses and into the annular groove in the cam surface, so as to move the spring seat axially relative to the rotor and away from the outer surface of the plate portion of the rotor, and so that the rotor is able to pivot relative to the cam member, whereby the handle is able to pivot relative to the pivoting member of the lock mechanism, providing an anti-ligature function.

* * * * *